United States Patent [19]

Jalbert

[11] Patent Number: 4,465,010

[45] Date of Patent: Aug. 14, 1984

[54] SAIL AND METHOD OF CONSTRUCTION

[76] Inventor: Domina C. Jalbert, 170 NW. 20th St., Boca Raton, Fla. 33432

[21] Appl. No.: 367,141

[22] Filed: Apr. 9, 1982

[51] Int. Cl.[3] ..... B63H 9/04

[52] U.S. Cl. ..... 114/103

[58] Field of Search ..... 114/39, 102, 103; D12/303

[56] References Cited

U.S. PATENT DOCUMENTS

| | | | |
|---|---|---|---|
| 1,792,106 | 2/1931 | Luders | 114/103 |
| 2,159,923 | 5/1939 | Willard | 114/103 |
| 2,499,598 | 3/1950 | Maurer et al. | 114/103 |
| 2,544,770 | 3/1951 | Willis | 114/103 |
| 2,565,219 | 8/1951 | Gardiner et al. | 114/103 |
| 3,487,800 | 1/1970 | Schweitzer et al. | 114/39 |
| 3,680,519 | 8/1972 | Jalbert | 114/103 |
| 3,974,791 | 8/1976 | Haarstick et al. | 114/103 |

FOREIGN PATENT DOCUMENTS

| | | | |
|---|---|---|---|
| 2501326 | 7/1976 | Fed. Rep. of Germany | 114/102 |

*Primary Examiner*—Trygve M. Blix
*Assistant Examiner*—Stephen P. Avila
*Attorney, Agent, or Firm*—Jack N. McCarthy

[57] ABSTRACT

A sail having a built-in-pocket and its method of construction is disclosed. A sail having foot and luff measurements and a desired angle at the finally formed tack is formed from sail material and has a built-in-pocket at a desired location. In forming the sail, the luff is pivoted forwardly on sail material about its upper edge to a sail forming position and the foot is pivoted downwardly on sail material about its rearward edge to a sail forming position; the amount that the bottom edge of the luff is moved forwardly determines the depth of the pocket; a first edge is formed between the moved end of the luff and a desired point providing the location of the center of the pocket; a second edge, equal to the first edge, is formed between the moved end of the foot and the desired point, the mating edges are fixed together, such as by sewing.

4 Claims, 3 Drawing Figures

HEAD
A
E
TACK
CLEW
D
B
F
C

A
E
D
F
C 4
8
6
10
E
B
D & F

SAIL AND METHOD OF CONSTRUCTION

TECHNICAL FIELD

This invention relates to the field of sailing and more particularly to a three-dimensional sail; that is, a sail having a built-in-pocket and its method of construction.

BACKGROUND ART

Some prior art patents of sails having a built-in-pocket, or pockets, are shown in U.S. Pat. Nos. 2,159,923; 2,499,598; 2,565,219; and 3,680,519.

DISCLOSURE OF INVENTION

It is an object of this invention to provide a sail having a built-in-pocket placed at a desired location.

Another object of this invention is to provide a method of forming a sail having known foot and luff measurements and a known angle where they meet at the tack with a built-in-pocket at a desired location in the body of the sail.

A further object of this invention is to provide a method of forming a sail from sail material with the luff of the sail being formed with the lower end of the luff being located forward of its final assembled position and the foot of the sail being formed with the forward end of the foot being located below its final assembled position; the lower end of the luff and the forward end of the foot each being located an equal distance from a point in the body at the sail material for locating the center of the pocket to be built-in; forming a first edge in the sail material from the lower end of the luff to the point locating the center of the built-in pocket and forming a second edge in the sail material from the forward end of the foot to the point locating the center of the built-in-pocket; fixing said first edge and second edge together forming the tack of the sail.

Another object of this invention is to provide a method of forming a sail where the luff of the sail being built is formed of sail material with the lower end of the luff being located a predetermined distance forward of its final assembled position, said predetermined distance having been selected to obtain the desired depth of the pocket to be built-in; a point is selected in the body of the sail material for placing the center of the pocket to be built-in; a first edge is formed in the sail material from the lower end of the luff to the selected point in the body of the sail material; the foot of the sail being built is formed of the sail material with the forward end of the foot being located below its final assembled position a predetermined distance from the point selected as the center of the pocket, said predetermined distance being equal to the distance between the point selected as the center of the pocket and the lower end of the luff; a second edge is formed in the sail material from the forward end of the foot to the selected point in the body of the sail material; the first edge of the sail material is fixed to the second edge of the sail material bringing the lower end of the luff and the forward end of the foot together to form the final tack position, said sail having the desired foot and luff measurements and the selected position of the built-in-pocket.

BEST MODE FOR CARRYING OUT THE INVENTION

Figures 1, 2, 3:
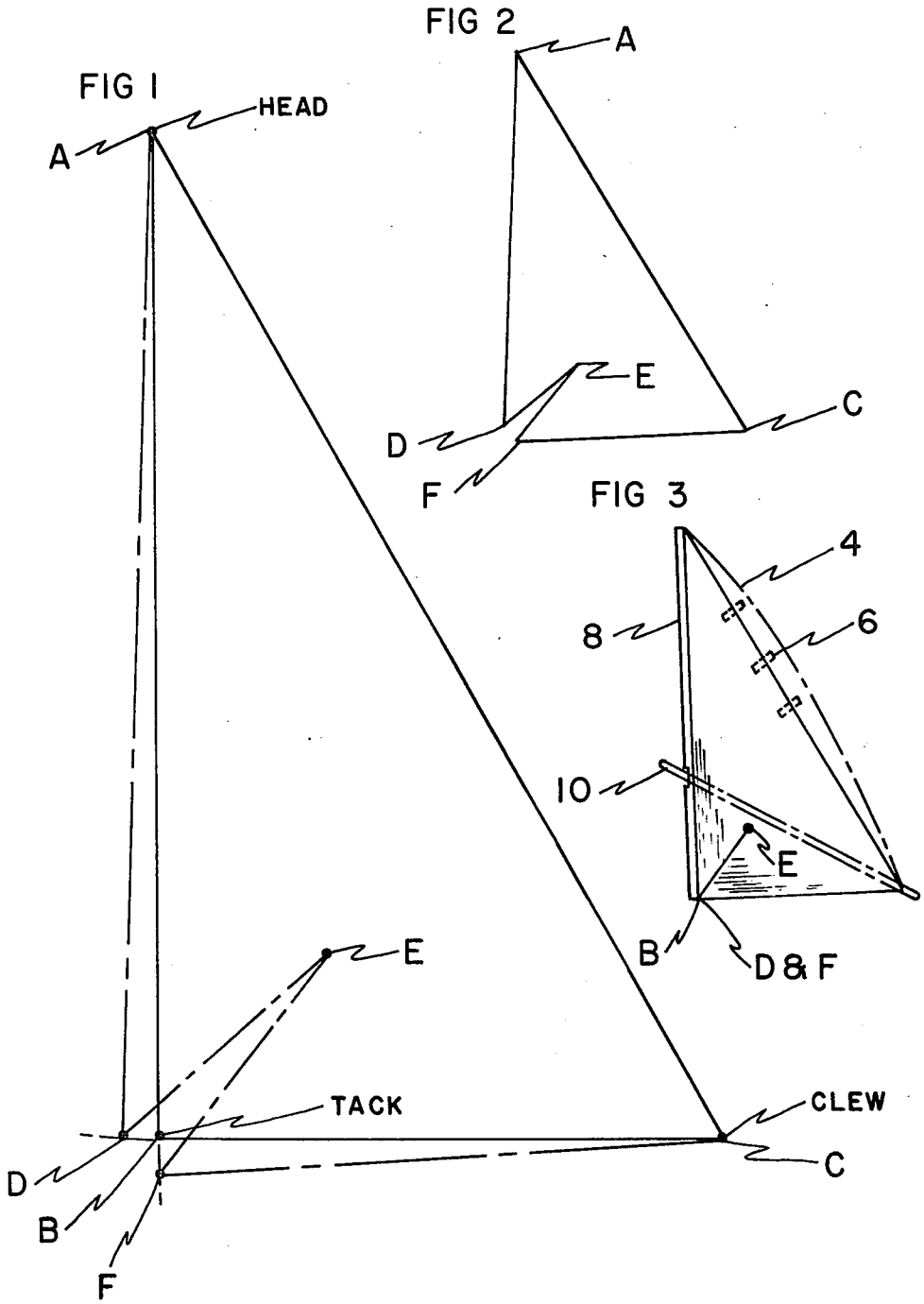
FIG. 1 is a view showing a side projection of a sail with a portion in phantom to show pocket construction.
FIG. 2 is a view of the side projection of sail material cut to form a finished sail having a desired built-in-pocket.
FIG. 3 is a side view of a finished sail having a built-in-pocket with a center at a desired location, including a skirt on the leech with battens shown in phantom and a mast sleeve shown forwardly of the luff.

A sail 2 is shown having a desired length along the luff A-B of the sail from the head to the tack and a desired length along the foot B-C of the sail from the tack to the clew, and a desired angle at the tack between the luff and the foot. To determine the pattern, or design configuration, for sail material to form a sail with a built-in-pocket having a center placed where desired, from said requirements, the luff A-B of the sail is drawn in and the foot B-C of the sail is drawn in.

The lower end of the luff of the sail is pivoted forwardly about its upper end A to a point D where it is located a distance forwardly of point B to provide a proper depth for the built-in-pocket. A point E is selected in the body of the sail to locate the center of the pocket. The forward end of the foot of the sail is pivoted downwardly about its rear end C to a point F where it is located a distance downwardly of point B, point F is pivoted downwardly until the distance E-F is equal to E-D, providing for edges D-E and F-E to be of a proper length to be fixed together when this pattern, or design configuration, has been formed of sail material to form a finished sail.

FIG. 2 shows the pattern, or design, configuration which will form a desired built-in-pocket when edges D-E and F-E are fixed together. FIG. 3 shows a finished sail having lines D-E and F-E fixed together, such as by sewing, and with the points D and F both appearing at the finished tack B of the sail.

As in conventional said construction, a continuous convex curve can be placed on the leech, as shown in phantom, to form a skirt 4 and if desired, also placed on the luff and on the foot. Battens 6 can be provided if believed necessary to support the skirt 4 for proper sail action. A mast sleeve 8 is fixed to the forward part of the luff to receive a mast. Further, the sail material can be laid out to form a sail as presently known in conventional sail construction, one method being of forming a large enough sail area by attaching a series of strips of sail cloths of uniform width. However, any conventional means can be used.

It can be seen that with the center E of the built-in-pocket selected, the length of lines E-D and E-F can be selected so that their arc as pivoted about E will intersect the arc of the luff at D as it is pivoted about A, and it will intersect the arc of the foot at F as it is pivoted about C.

The location of point D forwardly of point B is determined for each size sail and type of sail. One skilled in the art of sailing could easily determine the amount of material necessary to provide the desired depth. In a sail constructed for a sailboard, the luff of the sail was made 14′ and the foot of the sail was made 8′ with the tack angle approximately 90°. The distance D-B was made 5 inches which was approximately 3% of the luff. It is to be understood that if a sail maker, or designer, wishes to have a deeper pocket, it is only necessary that he extend the length of line D-B. It can be seen that this can also be done by extending the length of the line D-E. It is believed that for this size sail to achieve good performance, the distance D-B should be within 4" to 6".

Further, in the design of a sail for a sailboard, a window can be placed therein to provide for safe maneuvering of the sailboard. In the formation of a sail 2 having a built-in-pocket, such as described herein, it was found that in a sailboard having an elliptical boom, known as a wishbone boom, the center of the built-in-pocket E provides good handling when placed below the normal plane of the wishbone boom. A wishbone boom 10 is shown in phantom in FIG. 3. In further studies, it appears that the center of the built-in-pocket E should also be kept above approximately a distance 1/7 of the luff from the tack B and between distances from the luff A-B of from 20% to 35% of the foot. However, it is within the field of the sail maker, or designer, to determine by mathematical means, or by trail and error, just where he believes the center of his built-in-pocket E should be, and how deep it should be.

I claim:

1. A method of forming a sail from sail material, said sail having a luff with a desired luff measurement (B-A), a foot with a desired foot measurement (B-C), and a desired angle at a tack (B), with a built-in-pocket;

(1) placing the luff measurement (B-A) including an upper end (A) and a lower end (B) and the foot measurement (B-C) including a first end (C) and a second end (B) on the sail material with the desired angle therebetween;

(2) selecting a point (E) in the sail material for placing the center of the built-in-pocket;

(3) pivoting the luff measurement (B-A) about the upper end (A), moving the lower end (B) forwardly away from the selected point (E) a predetermined distance to a first new point (D) on the sail material, said predetermined distance having been selected to obtain the desired depth of the built-in-pocket;

(4) forming the luff in the sail material between the upper end (A) of the luff measurement (B-A) and the first new point (D);

(5) forming a first edge (D-E) in the sail material from the first new point (D) of the luff of the sail material to the selected point (E) in the sail material;

(6) pivoting the foot measurement (B-C) about the first end (C), moving the second end (B) downwardly away from the selected point (E) a predetermined distance to a second new point (F) on the sail material, said predetermined distance having been selected to obtain the desired depth of the built-in-pocket;

(7) forming the foot in the sail material between the first end (C) of the foot measurement (B-C) and the second new point (F);

(8) forming a second edge (F-E) in the sail material from the second new point (F) of the foot of the sail material to the selected point (E) in the sail material;

(9) forming a desired leech in the sail material between the upper end (A) of the luff and the first end (C) of the foot; and

(10) fixing the first edge (D-E) in the sail material to the second edge (F-E) in the sail material to form the tack having the desired luff and foot measurements, the desired angle, and the built-in-pocket.

2. A method of forming a sail from sail material, said sail having a luff with a desired luff measurement (B-A), a foot with a desired foot measurement (B-C), and a desired angle at a tack (B), with a built-in-pocket;

(1) placing the luff measurement (B-A) including an upper end (A) and a lower end (B) and the foot measurement (B-C) including a first end (C) and a second end (B) on the sail material with the desired angle therebetween;

(2) selecting a point (E) in the sail material for placing the center of the built-in-pocket;

(3) pivoting the luff measurement (B-A) about the upper end (A), moving the lower end (B) forwardly away from the selected point (E) a predetermined distance to a new lower end point (D) on the sail material, said predetermined distance having been selected to obtain the desired depth of the built-in-pocket;

(4) forming the luff in the sail material between the upper end (A) of the luff measurement (B-A) and the new lower end point (D);

(5) forming an edge (D-E) in the sail material from the new lower end point (D) of the luff of the sail material to the selected point (E) in the sail material;

(6) pivoting the foot measurement (B-C) about the first end (C), moving the second end (B) downwardly away from the selected point (E) a predetermined distance to a new second end point (F) on the sail material, said predetermined distance having been selected to obtain the desired depth of the built-in-pocket;

(7) forming the foot in the sail material between the first end (C) of the foot measurement (B-C) and the new second end point (F);

(8) forming an edge (F-E) in the sail material from the new second end point (F) of the foot of the sail material to the selected point (E) in the sail material;

(9) forming a desired leech in the sail material between the upper end (A) of the luff and the first end (C) of the foot; and

(10) fixing the edge (D-E) in the sail material from the new lower end point (D) of the luff of the sail material to the selected point (E) in the sail material to the edge (F-E) in the sail material from the new second end point (F) of the foot of the sail material to the selected point (E) in the sail material to form the tack having the desired luff and foot measurements, the desired angle, and the built-in-pocket.

3. A method of forming a pattern for a sail from pattern material, said sail having a luff with a desired luff measurement (B-A), a foot with a desired foot measurement (B-C), and a desired angle at a tack (B), with a built-in-pocket;

(1) placing the luff measurement (B-A) including an upper end (A) and a lower end (B) and the foot measurement (B-C) including a first end (C) and a second end (B) on the material with the desired angle therebetween;

(2) selecting a point (E) in the material for placing the center of the built-in-pocket;

(3) pivoting the luff measurement (B-A) about the upper end (A), moving the lower end (B) forwardly away from the selected point (E) a predetermined distance to a first new point (D) on the material, said predetermined distance having been selected to obtain the desired depth of the built-in-pocket;

(4) forming the luff in the material between the upper end (A) of the luff measurement (B-A) and the first new point (D);

(5) forming a first edge (D-E) in the material from the first new point (D) of the luff of the material to the selected point (E) in the material;

(6) pivoting the foot measurement (B-C) about the first end (C), moving the second end (B) downwardly away from the selected point (E) a predetermined distance to a second new point (F) on the material, said predetermined distance having been selected to obtain the desired depth of the built-in-pocket;

(7) forming the foot in the material between the first end (C) of the foot measurement (B-C) and the second new point (F);

(8) forming a second edge (F-E) in the material from the second new point (F) of the foot of the material to the selected point (E) in the materials; and (9) forming a desired leech in the material between the upper end (A) of the luff and the first end (C) of the foot.

4. A method of forming a pattern for a sail from pattern material, said sail having a luff with a desired luff measurement (B-A), a foot with a desired foot measurement (B-C), and a desired angle at a tack (B), with a built-in-pocket;

(1) placing the luff measurement (B-A) including an upper end (A) and a lower end (B) and the foot measurement (B-C) including a first end (C) and a second end (B) on the material with the desired angle therebetween;

(2) selecting a point (E) in the material for placing the center of the built-in-pocket;

(3) pivoting the luff measurement (B-A) about the upper end (A), moving the lower end (B) forwardly away from the selected point (E) a predetermined distance to a new lower end point (D) on the material, said predetermined distance having been selected to obtain the desired depth of the built-in-pocket;

(4) forming the luff in the material between the upper end (A) of the luff measurement (B-A) and the new lower end point (D);

(5) forming an edge (D-E) in the material from the new lower end point (D) of the luff of the material to the selected point (E) in the material;

(6) pivoting the foot measurement (B-C) about the first end (C), moving the second end (B) downwardly away from the selected point (E) a predetermined distance to a new second end point (F) on the material, said predetermined distance having been selected to obtain the desired depth of the built-in-pocket;

(7) forming the foot in the material between the first end (C) of the foot measurement (B-C) and the new second end point (F);

(8) forming an edge (F-E) in the material from the new second end point (F) of the foot of the material to the selected point (E) in the material; and (9) forming a desired leech in the material between the upper end (A) of the luff and the first end (C) of the foot.

* * * * *